US008699929B2

(12) United States Patent
Sakaya et al.

(10) Patent No.: US 8,699,929 B2
(45) Date of Patent: Apr. 15, 2014

(54) GUIDE DEVICE WITH MECHANISM CAPABLE OF MINIMIZING DAMAGE TO TONER IMAGE AND RECORDING MEDIUM AND FIXING DEVICE AND IMAGE FORMING APPARATUS INCORPORATING SAME

(75) Inventors: Kohta Sakaya, Hyogo (JP); Yoshiharu Takahashi, Osaka (JP); Tamotsu Ikeda, Osaka (JP); Chikara Hiraoka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 44 days.

(21) Appl. No.: 13/525,971

(22) Filed: Jun. 18, 2012

(65) Prior Publication Data

US 2013/0004214 A1 Jan. 3, 2013

(30) Foreign Application Priority Data

Jun. 30, 2011 (JP) ..... 2011-146132

(51) Int. Cl.
*G03G 15/20* (2006.01)

(52) U.S. Cl.
USPC ..... 399/323; 399/398; 399/399

(58) Field of Classification Search
USPC ..... 399/322, 323, 398, 399
See application file for complete search history.

(56) References Cited

U.S. PATENT DOCUMENTS 8,090,303 B2 1/2012 Hayashi et al.
8,107,864 B2 1/2012 Saito et al.
8,200,134 B2 6/2012 Hamahashi et al.
8,532,550 B2 * 9/2013 Arakawa ..... 399/323
2009/0129836 A1 5/2009 Sakaya et al.
2010/0034548 A1 2/2010 Naitoh et al.
2010/0086334 A1 4/2010 Sakaya
2010/0239297 A1 9/2010 Sakaya et al.
2010/0260524 A1 10/2010 Hiraoka et al.
2011/0188874 A1 8/2011 Takahashi et al.
2011/0188896 A1 8/2011 Sakaya et al.
2011/0194864 A1 8/2011 Nakatake et al.
2011/0217055 A1 9/2011 Takehara et al.
2012/0002997 A1 1/2012 Hiraoka et al.
2012/0020681 A1 1/2012 Naitoh et al.
2012/0033997 A1 2/2012 Fujita et al.
2012/0045241 A1 2/2012 Takahashi et al.
2012/0063829 A1 3/2012 Matsuyama et al.

FOREIGN PATENT DOCUMENTS

JP 7-140831 6/1995
JP 2004-61854 2/2004

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

A guide device includes a fixing exit guide, a first rotary body, a second rotary body disposed downstream from the first rotary body in a recording medium conveyance direction and partially protruding from a guide face through a slot of the fixing exit guide to contact and support an image side of a recording medium conveyed over the second rotary body, and at least one guide rib mounted on the guide face of the fixing exit guide and extending substantially in the recording medium conveyance direction. The guide rib includes a contact face contacting the image side of the recording medium and a downstream end disposed downstream from the contact face in the recording medium conveyance direction to overlap the second rotary body in cross-section taken along a direction orthogonal to an axial direction of the second rotary body.

15 Claims, 9 Drawing Sheets

GUIDE DEVICE WITH MECHANISM CAPABLE OF MINIMIZING DAMAGE TO TONER IMAGE AND RECORDING MEDIUM AND FIXING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-146132, filed on Jun. 30, 2011, in the Japanese Patent Office, the entire disclosure of which is hereby incorporated by reference herein.

BACKGROUND OF THE INVENTION

1. Field of the Invention

Exemplary aspects of the present invention relate to a guide device, a fixing device, and an image forming apparatus, and more particularly, to a guide device for guiding a recording medium bearing a toner image and a fixing device and an image forming apparatus incorporating the guide device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device installed in such image forming apparatuses may include a fixing roller and an opposed pressing roller that apply heat and pressure to a recording medium bearing a toner image. For example, the pressing roller is pressed against the fixing roller heated by a heater to form a fixing nip therebetween through which the recording medium bearing the toner image is conveyed. As the fixing roller and the pressing roller rotate and convey the recording medium through the fixing nip, they apply heat and pressure to the recording medium, melting and fixing the toner image on the recording medium.

Thereafter, the recording medium bearing the toner image is discharged from the fixing nip toward the outside of the fixing device. However, the recording medium may adhere to the fixing roller due to an adhesive force of the toner image heated by the fixing roller. To address this circumstance, a separation pawl may be located at an exit of the fixing nip to separate the recording medium from the fixing roller. Since the separation pawl is also designed to contact and guide the recording medium to the outside of the fixing device, the separation pawl has a side effect of producing scratches on the toner image on the recording medium.

To address this problem, a guide roller may be disposed in proximity to the separation pawl to guide the recording medium separated from the fixing roller by the separation pawl toward the outside of the fixing device.

However, immediately after the recording medium is discharged from the fixing nip, the recording medium still stores heat conducted from the fixing roller, softening the toner image thereon. While the recording medium moves from the separation pawl to the guide roller, it comes into contact with the separation pawl and the guide roller. Hence, as the recording medium slides over the separation pawl and the guide roller, the separation pawl and the guide roller may scratch the softened toner image on the recording medium, thus producing scratches and glossy streaks on the toner image.

Additionally, immediately after the recording medium is discharged from the fixing nip, the leading edge of the recording medium may curl according to the image area on the recording medium and therefore strike and press against the guide roller with increased pressure. Accordingly, the leading edge of the recording medium may be bent substantially. Moreover, if the guide roller is configured to protrude from a guide plate through a slot created therein, the curled leading edge of the recording medium may enter the slot of the guide plate, rotating the guide roller backward and thereby rendering the guide roller to damage the recording medium.

SUMMARY OF THE INVENTION

This specification describes below an improved guide device. In one exemplary embodiment of the present invention, the guide device is disposed downstream from a fixing rotary body in a recording medium conveyance direction that heats a toner image on a recording medium, guiding the recording medium conveyed from the fixing rotary body. The guide device includes a separator separatably contacting an outer circumferential surface of the fixing rotary body to separate the recording medium from the fixing rotary body; a first rotary body disposed adjacent to the separator to contact and support an image side of the recording medium bearing the toner image; a fixing exit guide having a guide face facing the image side of the recording medium supported by the first rotary body and provided with a slot; a second rotary body disposed downstream from the first rotary body in the recording medium conveyance direction and partially protruding from the guide face through the slot of the fixing exit guide to contact and support the image side of the recording medium; and at least one guide rib mounted on the guide face of the fixing exit guide and extending substantially in the recording medium conveyance direction. The guide rib includes a contact face contacting the image side of the recording medium; and a downstream end disposed downstream from the contact face in the recording medium conveyance direction to overlap the second rotary body in cross-section taken along a direction orthogonal to an axial direction of the second rotary body.

This specification further describes an improved fixing device. In one exemplary embodiment of the present invention, the fixing device includes the guide device described above.

This specification further describes an improved image forming apparatus. In one exemplary embodiment of the present invention, the image forming apparatus includes the guide device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
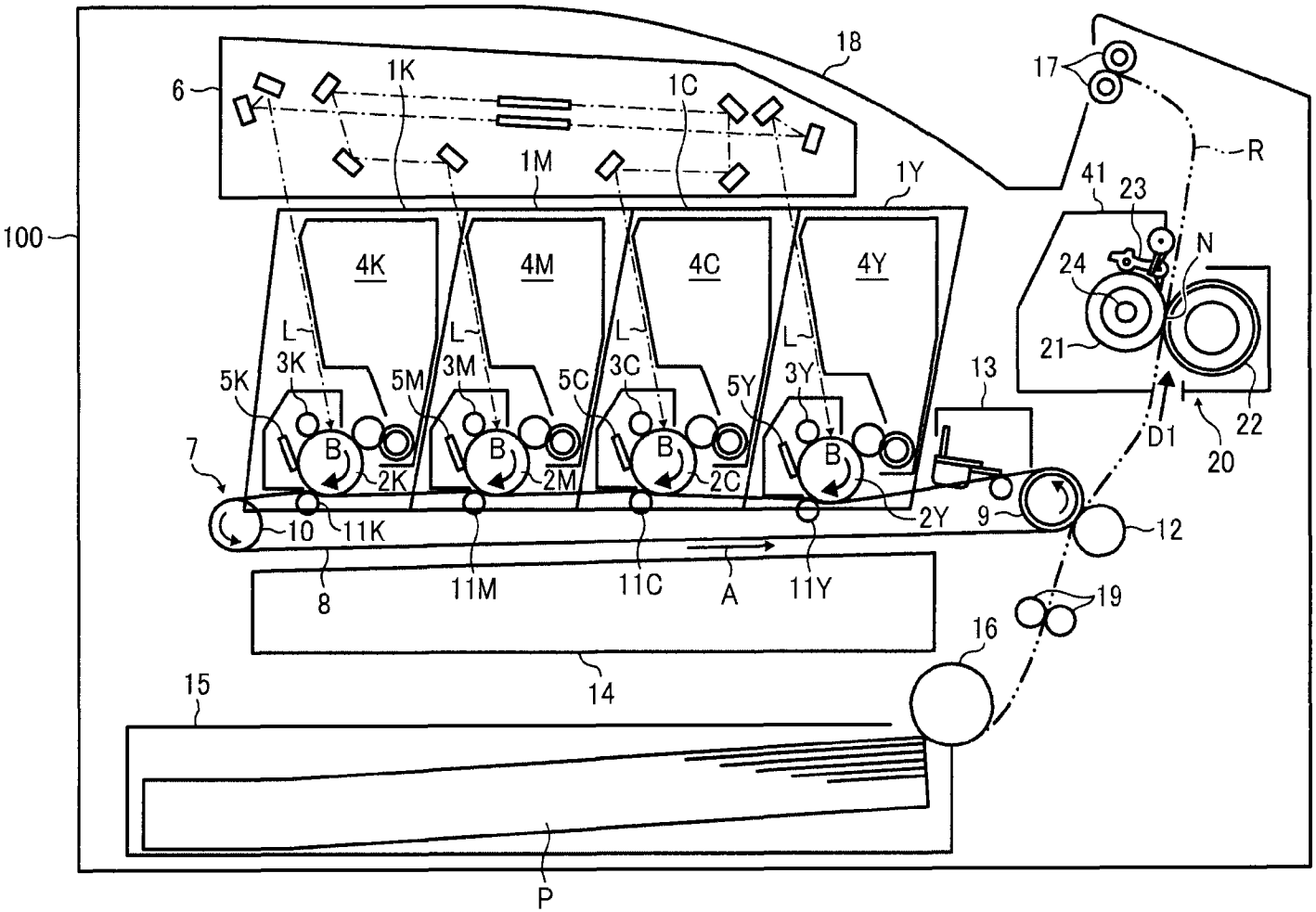
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present invention is explained.

FIG. 1 is a schematic vertical sectional view of the image forming apparatus 100. The image forming apparatus 100 may be a copier, a facsimile machine, a printer, a multifunction printer having at least one of copying, printing, scanning, plotter, and facsimile functions, or the like. According to this exemplary embodiment, the image forming apparatus 100 is a printer for forming color and monochrome toner images on a recording medium by electrophotography. The image forming apparatus 100 includes four process units 1Y, 1C, 1M, and 1K detachably attached thereto. Although the process units 1Y, 1C, 1M, and 1K contain yellow, cyan, magenta, and black toners that form yellow, cyan, magenta, and black toner images, respectively, resulting in a color toner image, they have an identical structure. Hence, the following describes the structure of one of them, that is, the process unit 1Y that forms a yellow toner image.

For example, the process unit 1Y includes a drum-shaped photoconductor 2Y serving as an image carrier that carries an electrostatic latent image and a resultant yellow toner image; a charging roller 3Y serving as a charger that charges an outer circumferential surface of the photoconductor 2Y; a development device 4Y serving as a development unit that supplies a developer (e.g., yellow toner) to the electrostatic latent image formed on the outer circumferential surface of the photoconductor 2Y, thus visualizing the electrostatic latent image into a yellow toner image with the yellow toner; and a cleaning blade 5Y serving as a cleaner that cleans the outer circumferential surface of the photoconductor 2Y.

Above the process units 1Y, 1C, 1M, and 1K is an exposure device 6 serving as an exposure unit that emits a laser beam L onto the outer circumferential surface of the respective photoconductors 2Y, 2C, 2M, and 2K to form an electrostatic latent image thereon. For example, the exposure device 6, constructed of a light source, a polygon mirror, an fθ theta lens, reflection mirrors, and the like, emits a laser beam L onto the outer circumferential surface of the respective photoconductors 2Y, 2C, 2M, and 2K according to image data sent from an external device such as a client computer.

Below the process units 1Y, 1C, 1M, and 1K is a transfer unit 7 that accommodates an endless intermediate transfer belt 8 serving as a transferor, a driving roller 9, a driven roller 10, four primary transfer rollers 11Y, 11C, 11M, and 11K, a secondary transfer roller 12, and a belt cleaner 13. Specifically, the endless intermediate transfer belt 8 is stretched over the driving roller 9 and the driven roller 10 that support the intermediate transfer belt 8. As the driving roller 9 rotates counterclockwise in FIG. 1, the intermediate transfer belt 8 rotates counterclockwise in FIG. 1 in a rotation direction A.

Inside a loop formed by the intermediate transfer belt 8 and opposite the four photoconductors 2Y, 2C, 2M, and 2K are the four primary transfer rollers 11Y, 11C, 11M, and 11K serving as primary transferors that transfer the yellow, cyan, magenta, and black toner images formed on the photoconductors 2Y, 2C, 2M, and 2K, respectively, onto an outer circumferential surface of the intermediate transfer belt 8. The primary transfer rollers 11Y, 11C, 11M, and 11K contact an inner circumferential surface of the intermediate transfer belt 8 and press the intermediate transfer belt 8 against the photoconductors 2Y, 2C, 2M, and 2K at opposed positions where the primary transfer rollers 11Y, 11C, 11M, and 11K are disposed opposite the photoconductors 2Y, 2C, 2M, and 2K, respectively, via the intermediate transfer belt 8, thus forming primary transfer nips between the photoconductors 2Y, 2C, 2M, and 2K and the intermediate transfer belt 8 where the yellow, cyan, magenta, and black toner images formed on the photoconductors 2Y, 2C, 2M, and 2K are primarily transferred onto the intermediate transfer belt 8 to form a color toner image thereon. The primary transfer rollers 11Y, 11C, 11M, and 11K are connected to a power supply that applies a predetermined direct current voltage and/or alternating current voltage thereto.

Opposite the driving roller 9 is the secondary transfer roller 12 serving as a secondary transferor that transfers the color toner image formed on the intermediate transfer belt 8 onto a recording medium P. The secondary transfer roller 12 contacts the outer circumferential surface of the intermediate transfer belt 8 and presses the intermediate transfer belt 8 against the driving roller 9, thus forming a secondary transfer nip between the secondary transfer roller 12 and the intermediate transfer belt 8 where the color toner image formed on the intermediate transfer belt 8 is transferred onto the recording medium P. Similar to the primary transfer rollers 11Y, 11C, 11M, and 11K, the secondary transfer roller 12 is connected to a power supply that applies a predetermined direct current voltage and/or alternating current voltage thereto.

The belt cleaner 13, disposed opposite the outer circumferential surface of the intermediate transfer belt 8 and in proximity to the secondary transfer nip, cleans the outer circumferential surface of the intermediate transfer belt 8. Below the intermediate transfer unit 7 is a waste toner container 14 that collects waste toner conveyed from the belt cleaner 13 through a waste toner conveyance tube extending from the belt cleaner 13 to an inlet of the waste toner container 14.

Below the waste toner container 14 in a lower portion of the image forming apparatus 100 is a paper tray 15 that loads a plurality of recording media P (e.g., sheets and OHP (overhead projector) transparencies). The paper tray 15 is attached with a feed roller 16 that feeds a recording medium P from the paper tray 15 toward a registration roller pair 19. In an upper portion of the image forming apparatus 100 are an output roller pair 17 that discharges the recording medium P onto an outside of the image forming apparatus 100 and an output tray 18 that receives and stocks the recording medium P discharged by the output roller pair 17.

The recording medium P fed by the feed roller 16 is conveyed upward through a conveyance path R that extends from the paper tray 15 to the output roller pair 17. The conveyance path R is provided with the registration roller pair 19 disposed below the secondary transfer nip formed between the secondary transfer roller 12 and the intermediate transfer belt 8, that is, upstream from the secondary transfer nip in a recording medium conveyance direction D1. The conveyance path R is further provided with a fixing device 20 disposed above the secondary transfer nip, that is, downstream from the secondary transfer nip in the recording medium conveyance direction D1.

For example, the fixing device 20 includes a fixing roller 21 serving as a fixing rotary body heated by a heater 24; a pressing roller 22 serving as a pressing rotary body that contacts the fixing roller 21 to form a fixing nip N therebetween; a separator 23 that separates the recording medium P from the fixing roller 21; and a fixing exit guide 41 that guides the recording medium P toward the output roller pair 17. According to this exemplary embodiment, a pressing mechanism presses the pressing roller 22 against the fixing roller 21, thus forming the fixing nip N therebetween. However, alternative configurations are possible.

For example, at least one of the fixing rotary body and the pressing rotary body may be an endless belt pressed against another one of the fixing rotary body and the pressing rotary body by a roller or a pad. Further, the pressing rotary body may not press against the fixing rotary body but may merely contact the fixing rotary body. The heater 24 may be a halogen lamp, a resistance heater, or the like. According to this exemplary embodiment, the heater 24 is situated inside the fixing roller 21. Alternatively, the heater 24 may be situated inside the pressing roller 22 or situated inside each of the fixing roller 21 and the pressing roller 22. Yet alternatively, an induction heater may be situated inside or outside the fixing roller 21 and the pressing roller 22. A detailed description of the fixing exit guide 41 is deferred.

Referring to FIG. 1, the following describes the operation of the image forming apparatus 100 having the structure described above.

As a print job starts, a driver drives and rotates the photoconductors 2Y, 2C, 2M, and 2K of the process units 1Y, 1C, 1M, and 1K, respectively, clockwise in FIG. 1 in a rotation direction B. The charging rollers 3Y, 3C, 3M, and 3K uniformly charge the outer circumferential surface of the respective photoconductors 2Y, 2C, 2M, and 2K at a predetermined polarity. The exposure device 6 emits laser beams L onto the charged outer circumferential surface of the respective photoconductors 2Y, 2C, 2M, and 2K according to yellow, cyan, magenta, and black image data contained in image data sent from the external device, respectively, thus forming electrostatic latent images thereon. The development devices 4Y, 4C, 4M, and 4K supply yellow, cyan, magenta, and black toners to the electrostatic latent images formed on the photoconductors 2Y, 2C, 2M, and 2K, visualizing the electrostatic latent images into yellow, cyan, magenta, and black toner images, respectively.

As the driving roller 9 is driven and rotated counterclockwise in FIG. 1, the driving roller 9 drives and rotates the intermediate transfer belt 8 counterclockwise in FIG. 1 in the rotation direction A. The power supply applies a constant voltage or a constant current control voltage having a polarity opposite a polarity of toner to the primary transfer rollers 11Y, 11C, 11M, and 11K. Thus, a transfer electric field is created at the primary transfer nips formed between the primary transfer rollers 11Y, 11C, 11M, and 11K and the photoconductors 2Y, 2C, 2M, and 2K, respectively. Accordingly, the yellow, cyan, magenta, and black toner images formed on the photoconductors 2Y, 2C, 2M, and 2K, respectively, are primarily transferred onto the intermediate transfer belt 8 successively by the transfer electric field created at the respective primary transfer nips, in such a manner that the yellow, cyan, magenta, and black toner images are superimposed on a same position on the intermediate transfer belt 8. Consequently, a color toner image is formed on the intermediate transfer belt 8. After the primary transfer of the yellow, cyan, magenta, and black toner images from the photoconductors 2Y, 2C, 2M, and 2K onto the intermediate transfer belt 8, the cleaning blades 5Y, 5C, 5M, and 5K remove residual toner not transferred onto the intermediate transfer belt 8 and therefore remaining on the photoconductors 2Y, 2C, 2M, and 2K therefrom. Then, dischargers discharge the outer circumferential surface of the respective photoconductors 2Y, 2C, 2M, and 2K, initializing the potential thereof so that the respective photoconductors 2Y, 2C, 2M, and 2K are ready for the next print job.

On the other hand, as the print job starts, the feed roller 16 is driven and rotated to feed a recording medium P from the paper tray 15 toward the registration roller pair 19 through the conveyance path R. The registration roller pair 19 feeds the recording medium P to the secondary transfer nip formed between the secondary transfer roller 12 and the intermediate transfer belt 8 at a time when the color toner image formed on the intermediate transfer belt 8 reaches the secondary transfer nip. The secondary transfer roller 12 is applied with a transfer voltage having a polarity opposite a polarity of the charged yellow, cyan, magenta, and black toners of the yellow, cyan, magenta, and black toner images constituting the color toner image formed on the intermediate transfer belt 8, thus creating a transfer electric field at the secondary transfer nip. Accordingly, the yellow, cyan, magenta, and black toner images constituting the color toner image are secondarily transferred from the intermediate transfer belt 8 collectively onto the recording medium P by the transfer electric field created at the secondary transfer nip. The recording medium P bearing the color toner image is conveyed to the fixing device 20 where the fixing roller 21 and the pressing roller 22 apply heat and pressure to the recording medium P, fixing the color toner image on the recording medium P. The separator 23 separates the recording medium P bearing the fixed color toner image from the fixing roller 21. Thereafter, the output roller pair 17 discharges the recording medium P onto the output tray 18. After the secondary transfer of the color toner image from the intermediate transfer belt 8 onto the recording medium P, the belt cleaner 13 removes residual toner not transferred onto the recording medium P and therefore remaining on the intermediate transfer belt 8 therefrom. The removed toner is conveyed and collected into the waste toner container 14.

The above describes the image forming operation of the image forming apparatus 100 to form the color toner image on the recording medium P. Alternatively, the image forming apparatus 100 may form a monochrome toner image by using any one of the four process units 1Y, 1C, 1M, and 1K or may form a bicolor or tricolor toner image by using two or three of the process units 1Y, 1C, 1M, and 1K.

Figure 2:
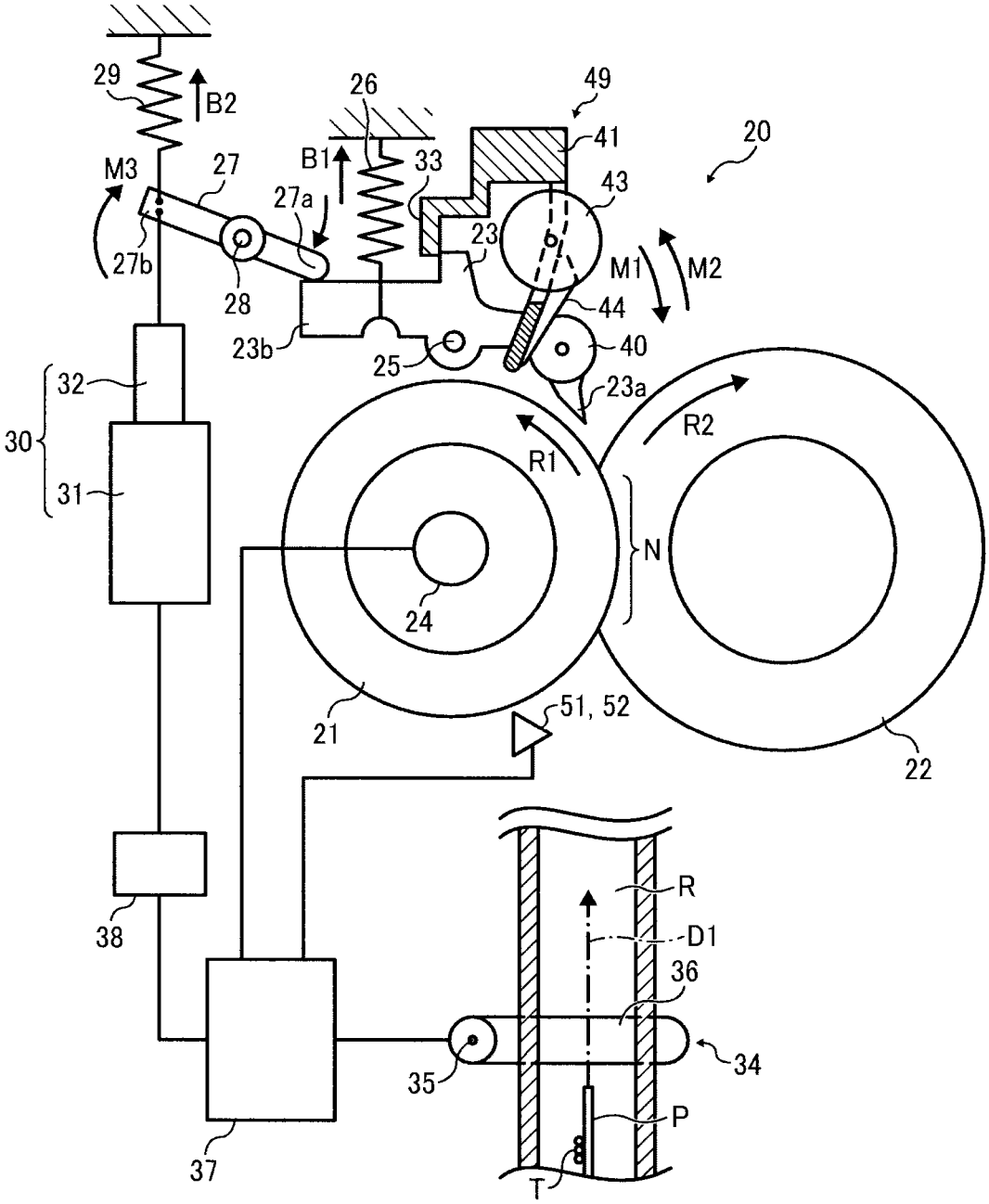
FIG. 2 is a vertical sectional view of a fixing device incorporated in the image forming apparatus shown in FIG. 1 in a state in which no recording medium is conveyed therethrough.
Figure 3:
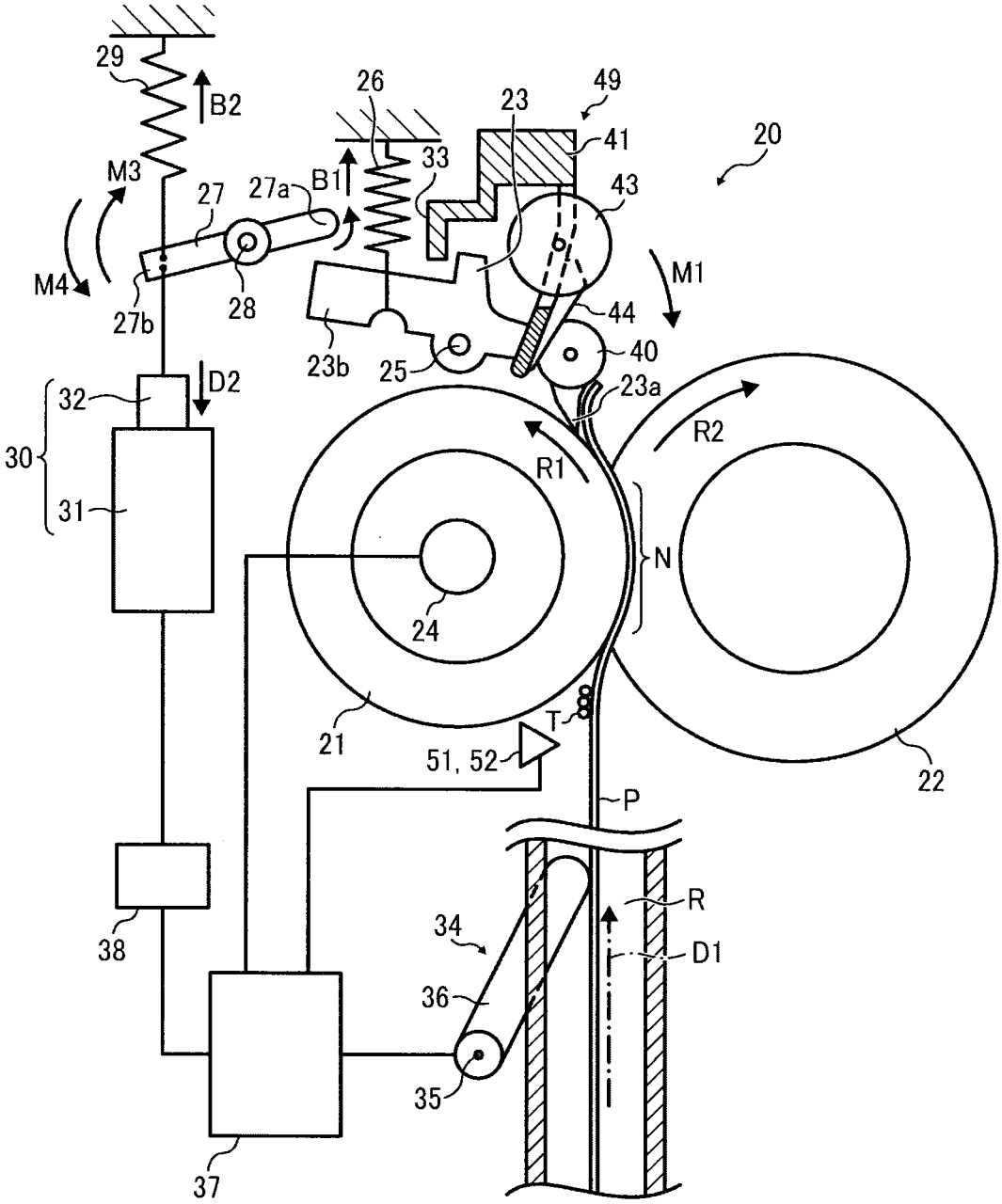
FIG. 3 is a vertical sectional view of the fixing device shown in FIG. 2 in a state in which a recording medium is conveyed therethrough.

Referring to FIGS. 2 and 3, the following describes the construction of the fixing device 20 installed in the image forming apparatus 100 described above.

FIG. 2 is a vertical sectional view of the fixing device 20 in a state in which no recording medium P is conveyed therethrough. FIG. 3 is a vertical sectional view of the fixing device 20 in a state in which a recording medium P is conveyed therethrough. As shown in FIG. 2, the fixing device 20 (e.g., a fuser unit) includes the fixing roller 21 heated by the heater 24 disposed inside the fixing roller 21. The fixing roller 21 is rotatable in a rotation direction R1 and the pressing roller 22 is rotatable in a rotation direction R2 counter to the rotation direction R1 of the fixing roller 21. The pressing roller 22 is pressed against the fixing roller 21 to form the fixing nip N therebetween.

As shown in FIG. 3, after the fixing roller 21 is heated by the heater 24 to a predetermined target fixing temperature, as the fixing roller 21 rotating in the rotation direction R1 and the pressing roller 22 rotating in the rotation direction R2 nip and convey a recording medium P bearing a toner image T through the fixing nip N formed between the fixing roller 21 and the pressing roller 22, the fixing roller 21 and the pressing roller 22 apply heat and pressure to the recording medium P, thus melting and fixing the toner image T on the recording medium P.

A thermistor 51 serving as a temperature detector that detects the temperature of the fixing roller 21 is disposed opposite an outer circumferential surface of the fixing roller 21. Similarly, a thermostat 52 preventing overheating of the fixing roller 21 is disposed opposite the outer circumferential surface of the fixing roller 21. A controller 37, that is, a central processing unit (CPU) provided with a random-access memory (RAM) and a read-only memory (ROM), for example, is operatively connected to the heater 24, the thermistor 51, and the thermostat 52. The controller 37 controls the heater 24 based on a detection signal output from the thermistor 51 so as to adjust the temperature of the outer circumferential surface of the fixing roller 21 to a predetermined fixing temperature range.

A detailed description is now given of the construction of the fixing roller 21.

The fixing roller 21 is a tube constructed of a thermal conductive base layer, an elastic layer coating the base layer, and an outer surface layer coasting the elastic layer. The thermal conductive base layer is made of a thermal conductive material having a predetermined mechanical strength, such as carbon steel, aluminum, or the like. The elastic layer is made of synthetic rubber such as silicone rubber, fluoro rubber, or the like. The outer surface layer is made of a heat-resistant, thermal conductive material that facilitates separation of the toner image T on the recording medium P from the fixing roller 21 and enhances the durability of the elastic layer. For example, the outer surface layer may be a fluoroplastic tube made of tetrafluoroethylene-perfluoroalkyl vinyl ether copolymer (PFA), a fluoroplastic coat made of PFA or polytetrafluoroethylene (PTFE), a silicone rubber layer, a fluoro rubber layer, or the like.

A detailed description is now given of the construction of the pressing roller 22.

The pressing roller 22 is a tube constructed of a metal core, an elastic layer coating the metal core, and an outer surface layer coating the elastic layer. For example, the metal core is made of carbon steel tubes for machine structural purposes (STKM). The elastic layer is made of silicone rubber, fluoro rubber, silicone rubber foam, fluoro rubber foam, or the like. The outer surface layer is a heat-resistant fluoroplastic tube made of PFA, PTFE, or the like that facilitates separation of the toner image T on the recording medium P from the pressing roller 22.

A detailed description is now given of the construction of the separator 23.

The separator 23 is disposed downstream from the fixing nip N in the recording medium conveyance direction D1 and opposite the outer circumferential surface of the fixing roller 21.

A detailed description is now given of a configuration of a mechanism that moves the separator 23 with respect to the fixing roller 21.

FIGS. 2 and 3 illustrate one example of such mechanism, that is, a contact direction biasing member 26, a separator presser 27, and a separation direction biasing member 29. It is to be noted that since the fixing device 20 includes a plurality of separators 23, a plurality of contact direction biasing members 26 corresponds to the plurality of separators 23. As shown in FIGS. 2 and 3, the contact direction biasing member 26 is anchored to a base 23*b* of the separator 23 constituting one end of the separator 23 in a longitudinal direction thereof disposed opposite a pawl 23*a* constituting another end of the separator 23 in the longitudinal direction thereof According to this exemplary embodiment, a tension coil spring is used as the contact direction biasing member 26. Alternatively, other biasing members may be used as the contact direction biasing member 26 in view of location and manufacturing costs of the contact direction biasing member 26. The contact direction biasing member 26 biases the separator 23 against the fixing roller 21, thus bringing the separator 23 into contact with the outer circumferential surface of the fixing roller 21.

On the other hand, the separator presser 27 separatably contacts the base 23*b* of the separator 23 to separate the separator 23 from the fixing roller 21. The separator presser 27 is supported by a shaft 28 in such a manner that the separator presser 27 is rotatable about the shaft 28. As the separator presser 27 rotates about the shaft 28 clockwise and counterclockwise in FIG. 2, a free end 27*a* of the separator presser 27 disposed opposite the base 23*b* of the separator 23 comes into contact with and separates from the base 23*b* of the separator 23. The separator presser 27 extends in a direction parallel to an axial direction of the fixing roller 21, thus separatably contacting all of the plurality of separators 23 aligned in the axial direction of the fixing roller 21.

The separator presser 27 is made of lightweight resin having predetermined mechanical strength, heat resistance, and abrasion resistance, such as poly p-phenylene sulfide (PPS), polyphenylene sulfide (PPS), or polyetherketone (PEK). According to this exemplary embodiment, the shaft 28 made of SUS stainless steel is separately manufactured from the separator presser 27 to prevent bending of the separator presser 27 in a longitudinal direction thereof parallel to the axial direction of the fixing roller 21. Alternatively, the separator presser 27 may be made of other materials according to the size of the fixing device 20 and a resilient bias exerted to the separator 23 by the contact direction biasing member 26 and the separation direction biasing member 29.

The separation direction biasing member 29 is anchored to a linkage drivably connected to the separator presser 27 and exerts a resilient bias to the separator presser 27 that separates the separator 23 from the fixing roller 21. FIGS. 2 and 3 schematically illustrate the separation direction biasing member 29 anchored to a base 27*b* of the separator presser 27. As shown in FIG. 2, as the separation direction biasing member 29 pulls the base 27*b* of the separator presser 27 in a direction B2, the free end 27*a* of the separator presser 27 is brought into contact with the base 23*b* of the separator 23. Alternatively, other biasing members may be used as the separation direction biasing member 29 in view of location and manufacturing costs. The contact direction biasing member 26 constantly exerts a resilient bias to the separator 23 that brings the separator 23 into contact with the fixing roller 21. Conversely, the separation direction biasing member 29 exerts a resilient bias to the separator 23 via the separator presser 27 as needed that separates the separator 23 from the fixing roller 21.

A solenoid 30 is connected to the separator presser 27 and serves as a driver that drives the separator presser 27. For example, the solenoid 30 is constructed of a body 31 incorporating a coil and a plunger 32 that protrudes from and retracts into the coil. The plunger 32 is connected to the linkage drivably connected to the separator presser 27. FIGS. 2 and 3 schematically illustrate the plunger 32 connected to the base 27*b* of the separator presser 27. As the coil incorporated in the body 31 is excited and the plunger 32 is retracted into the body 31, the plunger 32 pulls down the base 27*b* of the separator presser 27, thus driving and rotating the separator presser 27 counterclockwise in FIG. 3.

Above the separator 23 in FIG. 2 is a detent 33 that contacts and halts the separator 23 at a predetermined halting position where the separator 23 is isolated from the fixing roller 21 with a predetermined interval therebetween. Accordingly, even if the separation direction biasing member 29 constantly pulls the base 27*b* of the separator presser 27 in the direction B2 and therefore the separator presser 27 presses against the base 23*b* of the separator 23 against the resilient bias exerted by the contact direction biasing member 26, thus separating the separator 23 from the fixing roller 21, the detent 33 halts the separator 23 at the predetermined halting position with an appropriate interval between the pawl 23*a* of the separator 23 and the outer circumferential surface of the fixing roller 21 regardless of variation in dimension and assembly of parts constituting the separator 23.

A recording medium detector 34 is located upstream from the fixing nip N in the recording medium conveyance direction D1 and detects a recording medium P conveyed toward the fixing nip N. The recording medium detector 34 is constructed of a shaft 35 and a feeler 36 swingably or rotatably supported by the shaft 35. As shown in FIG. 2, before the recording medium P touches the feeler 36, the feeler 36 intersects the conveyance path R. As the recording medium P conveyed through the conveyance path R comes into contact with and abuts the feeler 36, the feeler 36 detects the recording medium P and swings or rotates counterclockwise in FIG. 2 to a position shown in FIG. 3 where the feeler 36 retracts from the conveyance path R, allowing the recording medium P to move to the fixing nip N. After the recording medium P passes through the recording medium detector 34, the feeler 36 returns to a default position shown in FIG. 2 by its own weight or a bias exerted by a biasing member (e.g., a torsion coil spring). Specifically, the feeler 36 comes into contact with and is halted by a detent at the default position shown in FIG. 2.

For example, the feeler 36 is located at a position in proximity to a center of the conveyance path R in a width direction thereof orthogonal to the recording medium conveyance direction D1, thus preventing the recording medium P from being skewed by contact with the feeler 36. Such location of the feeler 36 facilitates smooth conveyance of the recording medium P that prevents creasing of the recording medium P and warping of a toner image T on the recording medium P, enhancing reliability in conveyance of the recording medium P.

According to this exemplary embodiment, the recording medium detector 34 is a contact detector that detects the recording medium P by contacting it. Alternatively, a non-contact detector, such as a reflection optical sensor or a transmission optical sensor, which detects the recording medium P without contacting it may be used. The non-contact detector provides an advantage of precluding skew of the recording medium P because it does not contact the recording medium P.

Further, a jam detector for detecting a jammed recording medium P may be located upstream from the fixing nip N in the recording medium conveyance direction D1. In this case, such jam detector may also serve as the recording medium detector 34. Accordingly, a separate detector that detects the recording medium P is unnecessary, downsizing the fixing device 20 and reducing manufacturing costs.

The solenoid 30 is driven based on a detection signal output from the recording medium detector 34. For example, the solenoid 30 is electrically connected to the recording medium detector 34 via a driving circuit 38 and the controller 37. The controller 37 is the CPU incorporating an input-output (I/O) port. When the recording medium detector 34 detects the recording medium P conveyed toward the fixing nip N and generates a detection signal, the controller 37 drives the solenoid 30 via the driving circuit 38 based on the detection signal sent from the recording medium detector 34.

A detailed description is now given of an operation of the above-described mechanism that moves the separator 23 with respect to the fixing roller 21.

FIG. 2 illustrates a non-contact state in which the separator 23 is isolated from the fixing roller 21 before the recording medium P reaches the recording medium detector 34. Since the recording medium detector 34 does not yet detect the recording medium P, the controller 37 does not drive the solenoid 30. Hence, the solenoid 30 does not drive the separator presser 27. Conversely, the separation direction biasing member 29 exerts a resilient bias to the separator presser 27 that pulls the base 27*b* of the separator presser 27 upward in FIG. 2 toward the separation direction biasing member 29, applying a rotation moment M3 clockwise in FIG. 2 to the separator presser 27. Accordingly, the rotation moment M3 causes the free end 27*a* of the separator presser 27 to press down the base 23*b* of the separator 23.

The separator presser 27 pressing down the base 23*b* of the separator 23 applies a rotation moment M2 counterclockwise in FIG. 2 to the separator 23. Simultaneously, the contact direction biasing member 26 pulls the base 23*b* of the separator 23 upward in FIG. 2, applying a rotation moment M1 clockwise in FIG. 2 to the separator 23. That is, the separator 23 receives the two forces in the opposite directions: the clockwise rotation moment M1 and the counterclockwise rotation moment M2 counter to the rotation moment M1. However, the rotation moment M2 applied by the separation direction biasing member 29 is greater than the rotation moment M1 applied by the contact direction biasing member 26. Accordingly, the pawl 23*a* of the separator 23 separates from the fixing roller 21. Before the recording medium P is conveyed through the fixing nip N, the pawl 23*a* of the separator 23 is isolated from the fixing roller 21, minimizing wear of the fixing roller 21 due to contact with the pawl 23*a* and therefore allowing the fixing roller 21 to apply heat and pressure to the recording medium P bearing the toner image T for an extended period of time for formation of a high quality toner image. Further, the separator 23 moved by the separation direction biasing member 29 is halted by the detent 33 at the predetermined halting position where the separator 23 is isolated from the fixing roller 21 with the predetermined interval therebetween.

As shown in FIG. 3, when the recording medium P conveyed toward the fixing nip N comes into contact with the feeler 36 of the recording medium detector 34, the controller 37 drives the solenoid 30 via the driving circuit 38 based on a detection signal sent from the recording medium detector 34. Specifically, when a predetermined electric current is supplied to the solenoid 30, the plunger 32 is retracted into the body 31 in a direction D2 against a resilient bias exerted by the separation direction biasing member 29. The plunger 32 pulls down the base 27*b* of the separator presser 27, rotating the free end 27*a* of the separator presser 27 counterclockwise in FIG. 3. Accordingly, the free end 27*a* of the separator presser 27 separates from the base 23*b* of the separator 23 and thus the separator presser 27 no longer presses down the separator 23.

As the separator presser 27 is isolated from the separator 23, the separator 23 receives only the rotation moment M1 applied by the contact direction biasing member 26. Accordingly, the separator 23 rotates clockwise in FIG. 3, bringing the pawl 23*a* into contact with the fixing roller 21.

Referring to FIGS. 2 to 8D, the following describes a guide device 49 incorporated in the fixing device 20.

Figure 4:
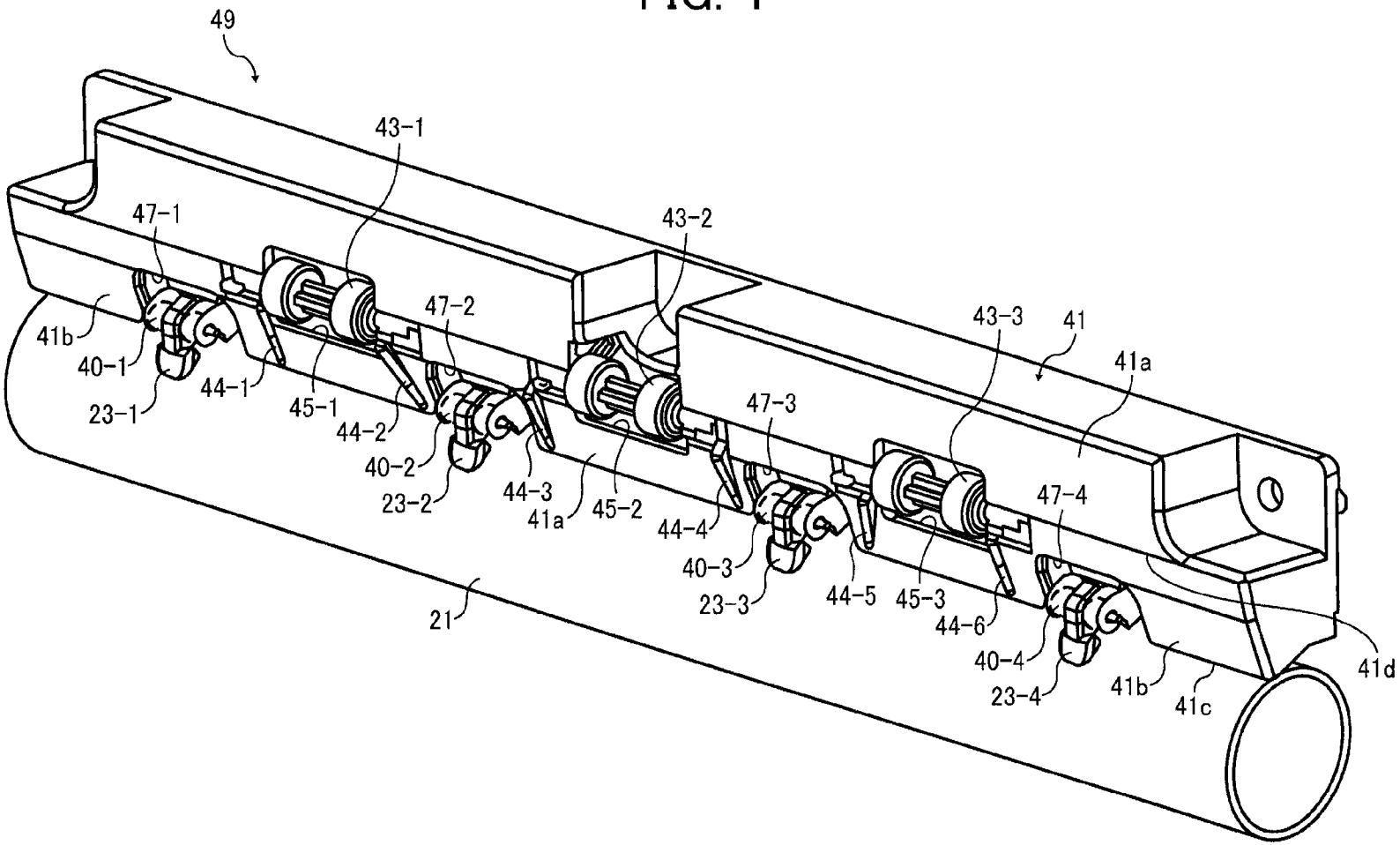
FIG. 4 is a perspective view of a guide device and a fixing roller incorporated in the fixing device shown in FIG. 3.
Figure 5:
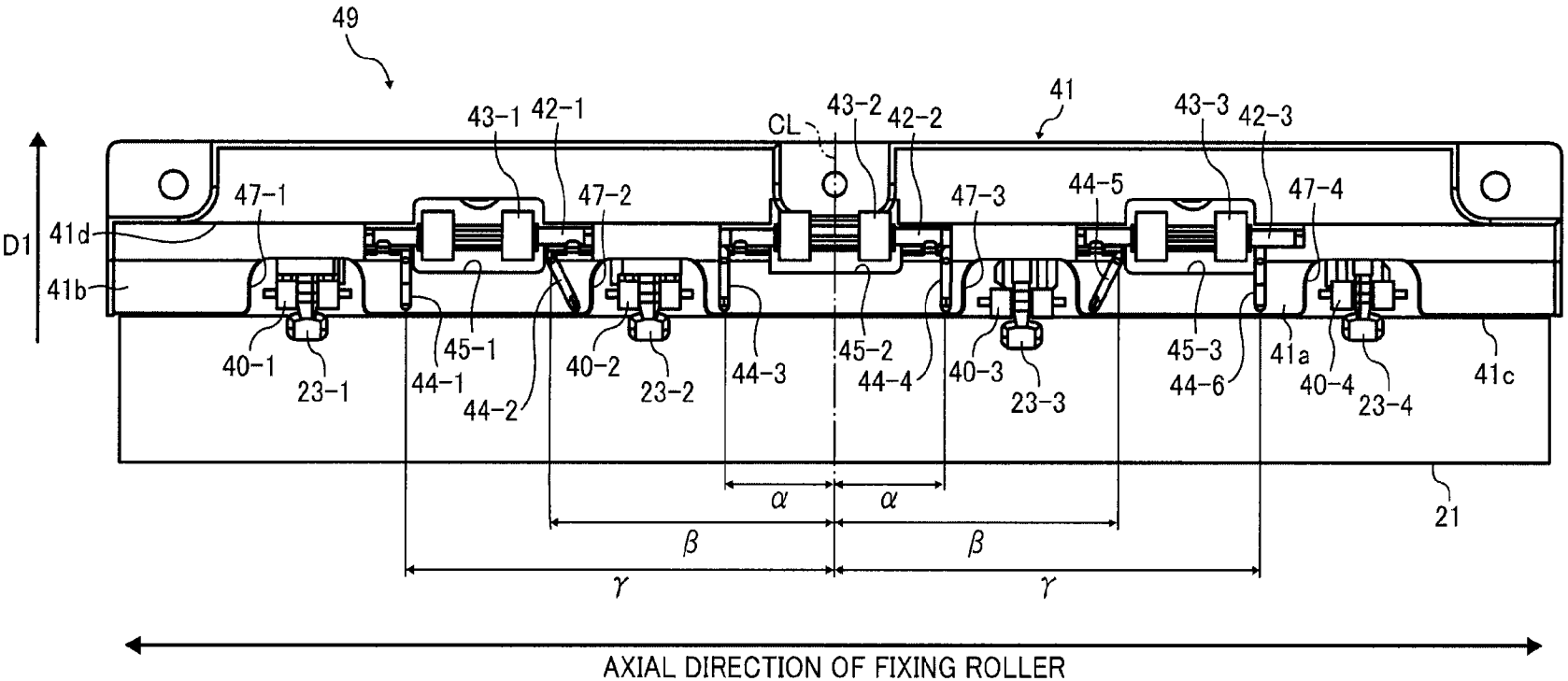
FIG. 5 is a horizontal front view of the guide device and the fixing roller shown in FIG. 4.
Figure 6:
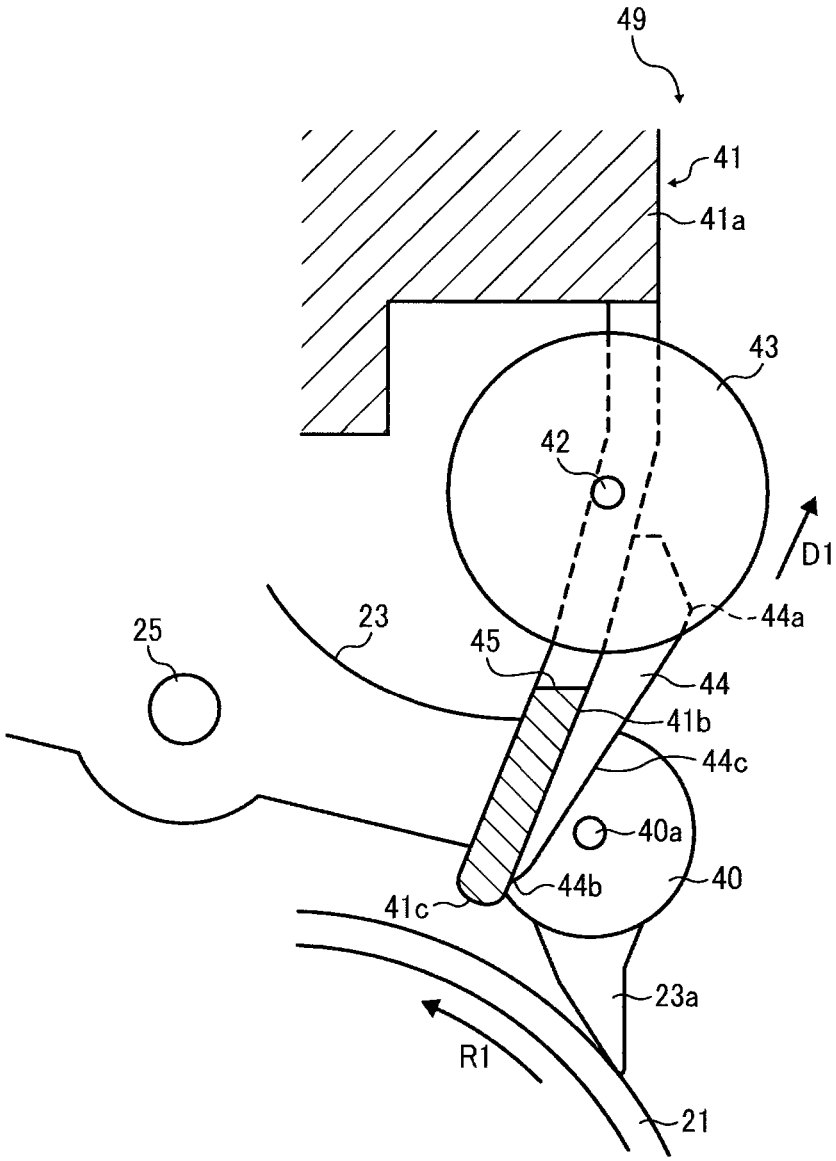
FIG. 6 is a vertical sectional view of the guide device shown in FIG. 5.
Figure 7B:
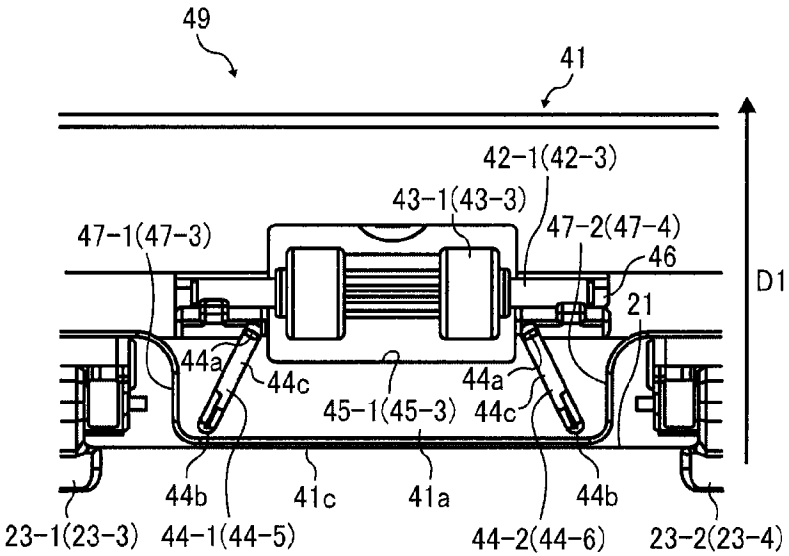
FIG. 7B is a partially enlarged horizontal front view of a fixing exit guide incorporated in the guide device shown in FIG. 5 illustrating side guide ribs mounted thereon.
Figure 7A:
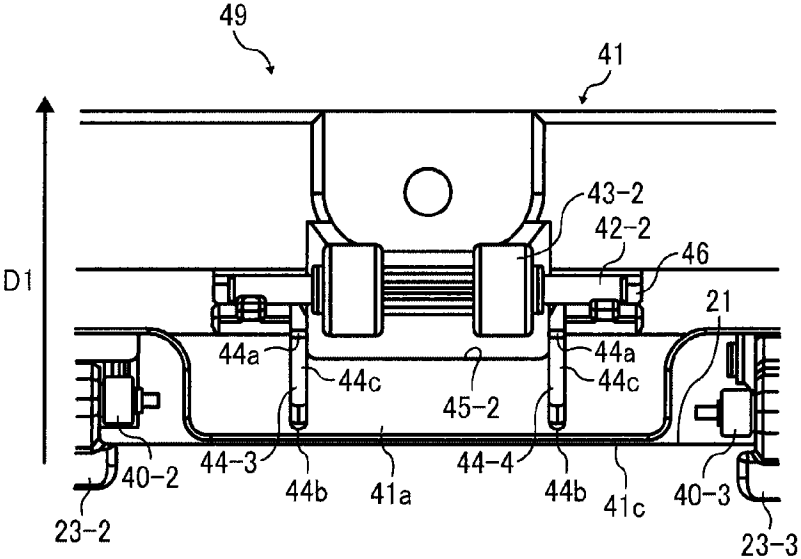
FIG. 7A is a partially enlarged horizontal front view of a fixing exit guide incorporated in the guide device shown in FIG. 5 illustrating center guide ribs mounted thereon.

FIG. 4 is a perspective view of the guide device 49 and the fixing roller 21. FIG. 5 is a horizontal front view of the guide device 49 and the fixing roller 21. FIG. 6 is a vertical sectional view of the guide device 49. FIG. 7A is a partially enlarged horizontal front view of the fixing exit guide 41 illustrating center guide ribs 44-3 and 44-4. FIG. 7B is a partially enlarged horizontal front view of the fixing exit guide 41 illustrating side guide ribs 44-1, 44-2, 44-5, and 44-6. FIGS. 8A to 8D illustrate a vertical sectional view of the guide device 49 showing movement of the recording medium P therethrough.

As shown in FIG. 2, the guide device 49 is located above the fixing roller 21, that is, downstream from the fixing nip N in the recording medium conveyance direction D1. The guide device 49 includes the separator 23, the fixing exit guide 41, a pawl roller pair 40, a guide roller pair 43, and a guide rib 44.

A detailed description is now given of a configuration of the fixing exit guide 41.

The lightweight fixing exit guide 41 has a heat resistance great enough to endure radiant heat from the fixing roller 21 and is made of a material readily molded into a complex shape such as polyethylene terephthalate (PET) containing glass fiber. As shown in FIG. 4, the fixing exit guide 41 is constructed of a vertical guide face 41*a* and a slanted guide face 41*b* constituting a front face of the fixing exit guide 41. Three guide roller pairs 43-1, 43-2, and 43-3, six guide ribs 44-1, 44-2, 44-3, 44-4, 44-5, and 44-6, four pawl roller pairs 40-1, 40-2, 40-3, and 40-4, four separators 23-1, 23-2, 23-3, and 23-4, three slots 45-1, 45-2, and 45-3, and four slots 47-1, 47-2, 47-3, and 47-4 are provided on the fixing exit guide 41. The vertical guide face 41*a* extends substantially vertically. The slanted guide face 41*b* is contiguous to the vertical guide face 41*a* in such a manner that a lower edge of the vertical guide face 41*a* and an upper edge, that is, a downstream edge 41*d*, of the slanted guide face 41*b* constitute a boundary between the vertical guide face 41*a* and the slanted guide face 41*b*. The slanted guide face 41*b* is slanted inwardly from the lower edge of the vertical guide face 41*a*.

The six guide ribs 44-1, 44-2, 44-3, 44-4, 44-5, and 44-6 are mounted on the slanted guide face 41*b* and guide the recording medium P discharged from the fixing nip N to the three guide roller pairs 43-1, 43-2, and 43-3 serving as a second rotary body, a detailed description of which is deferred. A lower edge, that is, an upstream edge 41*c* in the recording medium conveyance direction D1, of the slanted guide face 41*b* of the fixing exit guide 41 is located beside the pawl roller pairs 40-1, 40-2, 40-3, and 40-4 serving as a first rotary body and aligned with the pawl roller pairs 40-1, 40-2, 40-3, and 40-4 in an axial direction thereof. A predetermined interval is provided between the upstream edge 41*c* of the slanted guide face 41*b* and the outer circumferential surface of the fixing roller 21 so that the upstream edge 41*c* of the slanted guide face 41*b* does not contact and damage the fixing roller 21. As described above, the fixing device 20 depicted in FIG. 2 includes the plurality of separators 23 which is shown in FIG. 4 as the four separators 23-1, 23-2, 23-3, and 23-4.

The evenly spaced, three slots 45-1, 45-2, and 45-3 are created across the vertical guide face 41*a* and the slanted guide face 41*b* of the fixing exit guide 41 and aligned in the axial direction of the fixing roller 21. The three guide roller pairs 43-1, 43-2, and 43-3 are rotatably accommodated in the three slots 45-1, 45-2, and 45-3, respectively. For example, a part of an outer circumferential surface of the respective guide roller pairs 43-1, 43-2, and 43-3 protrudes outwardly from the respective slots 45-1, 45-2, and 45-3. The guide roller pairs 43-1, 43-2, and 43-3 are made of a heat-resistant material such as polybutylene terephthalate (PBT). As shown in FIG. 5, the three guide roller pairs 43-1, 43-2, and 43-3 are situated on three guide roller shafts 42-1, 42-2, and 42-3, respectively. As shown in FIGS. 7A and 7B, each of the guide roller shafts 42-1, 42-2, and 42-3 is readily attached to a bearing 46 mounted on the fixing exit guide 41 with a single motion. As shown in FIG. 4, according to this exemplary embodiment, six rollers constitute the guide roller pairs 43-1, 43-2, and 43-3. However, the number of the rollers used as the guide roller pairs 43-1, 43-2, and 43-3 may be changed as needed. As shown in FIG. 5, the center guide roller pair 43-2 is located at a position corresponding to a center of the fixing roller 21 in the axial direction thereof. The ambilateral guide roller pairs 43-1 and 43-3 are located symmetric with respect to the center guide roller pair 43-2. That is, the guide roller pairs 43-1, 43-2, and 43-3 correspond to a recording medium conveyance region through which the recording medium P is conveyed in a state in which the ambilateral guide roller pairs 43-1 and 43-3 are located symmetric with respect to a center line CL of the recording medium conveyance region that extends in the recording medium conveyance direction D1.

Below the guide roller pairs 43-1, 43-2, and 43-3 are the four separators 23-1, 23-2, 23-3, and 23-4 and the rotatable four pawl roller pairs 40-1, 40-2, 40-3, and 40-4. As shown in FIGS. 2 and 3, the separator 23 representing the separators 23-1, 23-2, 23-3, and 23-4 is rotatably supported by a shaft 25. As shown in FIG. 6, the shaft 25 is inboard from the slanted guide face 41*b* of the fixing exit guide 41 and both axial ends of the shaft 25 are rotatably mounted on side plates rotatably mounting both axial ends of the respective fixing roller 21 and the pressing roller 22. As shown in FIG. 5, each of the pawl roller pairs 40-1, 40-2, 40-3, and 40-4 is constructed of two rotatable rollers sandwiching the pawl 23*a* depicted in FIG. 2 of the respective four separators 23-1, 23-2, 23-3, and 23-4. As shown in FIG. 5, according to this exemplary embodiment, eight rollers constitute the four pawl roller pairs 40-1, 40-2, 40-3, and 40-4. However, the number of the rollers used as the pawl roller pairs 40-1, 40-2, 40-3, and 40-4 may be changed as needed. Each of the pawl roller pairs 40-1, 40-2, 40-3, and 40-4 includes a base made of a heat-resistant material such as PBT.

As shown in FIGS. 4 and 5, the four separators 23-1, 23-2, 23-3, and 23-4 are aligned in the axial direction of the fixing roller 21. A head portion of the respective separators 23-1, 23-2, 23-3, and 23-4 protrudes from slots 47-1, 47-2, 47-3, and 47-4 created through the slanted guide face 41*b* of the fixing exit guide 41 toward the fixing roller 21. The four separators 23-1, 23-2, 23-3, and 23-4 are rotatable about the shaft 25 depicted in FIG. 2 independently from each other.

As shown in FIG. 5, the four separators 23-1, 23-2, 23-3, and 23-4 are evenly or substantially evenly spaced in such a manner that the two separators 23-1 and 23-2 located in the left half in FIG. 5 and the two separators 23-3 and 23-4 located in the right half in FIG. 5 are symmetric with respect to the center line CL of the recording medium conveyance region in the axial direction of the fixing roller 21. The four separators 23-1, 23-2, 23-3, and 23-4 and the three guide roller pairs 43-1, 43-2, and 43-3 create two staggered rows, downsizing the fixing exit guide 41. The four separators 23-1, 23-2, 23-3, and 23-4 and the three guide roller pairs 43-1, 43-2, and 43-3 aligned in the two staggered rows also exert uniform pressure to the recording medium P throughout a width direction thereof parallel to the axial direction of the fixing roller 21, preventing the pawls 23*a* of the separators 23-1, 23-2, 23-3, and 23-4, the pawl roller pairs 40-1, 40-2, 40-3, and 40-4, and the guide roller pairs 43-1, 43-2, and 43-3 from producing scratches and glossy streaks on the toner image T on the recording medium P.

If the guide roller pairs 43-1, 43-2, and 43-3 are located downstream from the pawls 23*a* of the separators 23-1, 23-2, 23-3, and 23-4 in the recording medium conveyance direction D1 in such a manner that the guide roller pairs 43-1, 43-2, and 43-3 and the separators 23-1, 23-2, 23-3, and 23-4 do not create the two staggered rows, it is necessary to prevent the separators 23-1, 23-2, 23-3, and 23-4 and the pawl roller pairs 40-1, 40-2, 40-3, and 40-4 from touching or striking the guide roller pairs 43-1, 43-2, and 43-3. For example, if the guide roller pairs 43-1, 43-2, and 43-3 and the pawl roller pairs 40-1, 40-2, 40-3, and 40-4 have a greater diameter, a greater interval is needed between the guide roller pairs 43-1, 43-2, and 43-3 and the pawl roller pairs 40-1, 40-2, 40-3, and 40-4 in the recording medium conveyance direction D1, obstructing downsizing of the fixing exit guide 41. To address this problem, the guide roller pairs 43-1, 43-2, and 43-3 and the pawl roller pairs 40-1, 40-2, 40-3, and 40-4 create two staggered rows.

As shown in FIG. 5, the ambilateral guide roller pairs 43-1 and 43-3 are symmetric with respect to the center guide roller pair 43-2; the two separators 23-1 and 23-2 located in the left half in FIG. 5 and the two separators 23-3 and 23-4 located in the right half in FIG. 5 are symmetric with respect to the center line CL; the two pawl roller pairs 40-1 and 40-2 located in the left half in FIG. 5 and the two pawl roller pairs 40-3 and 40-4 located in the right half in FIG. 5 are symmetric with respect to the center line CL, maintaining the symmetrical shape of the recording medium P discharged from the fixing nip N and thereby preventing dog-ear and jamming of the recording medium P for smooth conveyance of the recording medium P. The evenly or substantially evenly spaced, four separators 23-1, 23-2, 23-3, and 23-4 cause the pawls 23*a* to exert a uniform force to the recording medium P throughout the width direction thereof. For example, a particular one of the pawls 23*a* of the separators 23-1, 23-2, 23-3, and 23-4 may not damage the fixing roller 21 by exerting a greater force to the fixing roller 21 while the pawls 23*a* contact the fixing roller 21 to separate the recording medium P from the fixing roller 21 as shown in FIG. 3.

As shown in FIG. 6, the pawl 23*a* constituting a head of the separator 23 representing the respective separators 23-1, 23-2, 23-3, and 23-4 depicted in FIG. 5 comes into contact with and separates from the outer circumferential surface of the fixing roller 21. The pawl 23*a* has a round front edge that does not damage the fixing roller 21 as it slides over the fixing roller 21. The pawl 23*a* contacts the fixing roller 21 in a direction counter to the rotation direction R1 of the fixing roller 21. The separator 23 is made of PFA, polyetherketone (PEK), polyether ether ketone (PEEK), or the like that facilitates separation from and sliding over the fixing roller 21. Alternatively, a surface of the separator 23 may be coated with PFA or Teflon® that facilitates separation from and sliding over the fixing roller 21.

The pawl roller pair 40 representing the respective pawl roller pairs 40-1, 40-2, 40-3, and 40-4 depicted in FIG. 5 is rotatably supported by a shaft 40*a*. The pawl roller pair 40 has a diameter smaller than that of the guide roller pair 43 representing the guide roller pairs 43-1, 43-2, and 43-3 depicted in FIG. 5. The pawl roller pair 40 is interposed between the pawl 23*a* and the guide roller pair 43 in the recording medium conveyance direction D1 and disposed in proximity to the pawl 23*a*. The shaft 40*a* is located outboard from the slanted guide face 41*b* and thus most part of the pawl roller pair 40 is located outboard from the slanted guide face 41*b*. The shaft 40*a* is substantially directly underneath a guide roller shaft 42 representing the respective guide roller shafts 42-1, 42-2, and 42-3 depicted in FIG. 5 that supports the guide roller pair 43. The guide roller pair 43 having a diameter greater than that of the pawl roller pair 40 protrudes outboard from the slanted guide face 41*b* farther than the pawl roller pair 40. The separator 23 is rotatable about the shaft 25, both axial ends of which are rotatably mounted on the side plates rotatably mounting both axial ends of the respective fixing roller 21 and the pressing roller 22. As the separator 23 rotates about the shaft 25 clockwise or counterclockwise in FIG. 6, the pawl 23*a* of the separator 23 comes into contact with and separates from the fixing roller 21.

Referring to FIGS. 4 to 6, a detailed description is now given of a configuration of the guide rib 44 representing the guide ribs 44-1, 44-2, 44-3, 44-4, 44-5, and 44-6.

It is to be noted that FIG. 6 illustrates the separator 23 representing the separators 23-1, 23-2, 23-3, and 23-4, the pawl roller pair 40 representing the pawl roller pairs 40-1, 40-2, 40-3, and 40-4, the guide roller shaft 42 representing the guide roller shafts 42-1, 42-2, and 42-3, the guide roller pair 43 representing the guide roller pairs 43-1, 43-2, and 43-3, the guide rib 44 representing the guide ribs 44-1, 44-2, 44-3, 44-4, 44-5, and 44-6, and a slot 45 representing the slots 45-1, 45-2, and 45-3 shown in FIG. 5.

As shown in FIG. 4, the plurality of guide ribs 44-1, 44-2, 44-3, 44-4, 44-5, and 44-6 is mounted on and molded with the slanted guide face 41*b* at positions beside the pawl roller pairs 40-1, 40-2, 40-3, and 40-4. As shown in FIG. 6, the guide rib 44 projects from the slanted guide face 41*b* at a predetermined height. As shown in FIG. 5, the six guide ribs 44-1, 44-2, 44-3, 44-4, 44-5, and 44-6 are situated on the slanted guide face 41*b* at six positions symmetric with respect to the center line CL of the fixing exit guide 41 in the axial direction of the fixing roller 21 and spaced apart from the center line CL for distances α, β, and γ from the center line CL in the axial direction of the fixing roller 21, that is, three positions in the left half in the recording medium conveyance region defined by the center line CL in the axial direction of the fixing roller 21 and another three positions in the right half in the recording medium conveyance region defined by the center line CL in the axial direction of the fixing roller 21. The six guide ribs 44-1, 44-2, 44-3, 44-4, 44-5, and 44-6 symmetric with respect to the center line CL exert a force to the recording medium P symmetrically with respect to the center line CL, shaping the recording medium P symmetrically with respect to the center line CL, even if the recording medium P is deformed accidentally, and therefore minimizing skew of the recording medium P.

As shown in FIG. 5, the guide ribs 44-1, 44-2, 44-3, 44-4, 44-5, and 44-6 extend linearly from a position below the downstream edge 41*d* to the upstream edge 41*c* of the slanted guide face 41*b*. For example, the outmost guide ribs 44-1 and 44-6 and the center guide ribs 44-3 and 44-4 extend parallel to the recording medium conveyance direction D1. By contrast, the guide ribs 44-2 and 44-5 are slanted at about 30 degrees with respect to the recording medium conveyance direction D1. Specifically, a downstream end 44*a* depicted in FIG. 6 of the respective guide ribs 44-2 and 44-5 is closer to the guide roller pairs 43-1 and 43-3 than an upstream end 44*b* depicted in FIG. 6 of the respective guide ribs 44-2 and 44-5.

Alternatively, the guide ribs 44-2 and 44-5 may not be slanted but may extend parallel to the recording medium conveyance direction D1 like the guide ribs 44-1, 44-3, 44-4, and 44-6. Even if all of the guide ribs 44-1, 44-2, 44-3, 44-4, 44-5, and 44-6 extend parallel to the recording medium conveyance direction D1, they can facilitate smooth guide and conveyance of the recording medium P to the guide roller pairs 43-1, 43-2, and 43-3. Yet alternatively, as shown in FIG. 7B, the downstream ends 44*a* of the respective guide ribs 44-1 and 44-2 sandwiching the leftmost guide roller pair 43-1 may be slanted with respect to the recording medium conveyance direction D1 to be closer to each other in a horizontal direction. Similarly, the downstream ends 44*a* of the respective guide ribs 44-5 and 44-6 sandwiching the rightmost guide roller pair 43-3 may be slanted with respect to the recording medium conveyance direction D1 to be closer to each other in the horizontal direction.

The slanted guide ribs 44-1, 44-2, 44-5, and 44-6 shorten time for which the guide ribs 44-1, 44-2, 44-5, and 44-6 contact the recording medium P and at the same time shorten a horizontal distance between the downstream end 44*a* of the respective guide ribs 44-1 and 44-2 and the guide roller pair 43-1 and a horizontal distance between the downstream end 44*a* of the respective guide ribs 44-5 and 44-6 and the guide roller pair 43-3, facilitating smooth conveyance of the recording medium P to the guide roller pairs 43-1 and 43-3. Alternatively, the four guide ribs 44-1, 44-3, 44-4, and 44-6 extending parallel to the recording medium conveyance direction D1 as shown in FIG. 5 may be slanted in either leftward or rightward along the axial direction of the fixing roller 21.

As shown in FIG. 6, the upstream end 44*b* of the guide rib 44 extends to a position beside the pawl roller pair 40. As seen in the axial direction of the pawl roller pair 40, the upstream end 44*b* of the guide rib 44 extends to a position in proximity to an outer circumference of the fixing roller 21 and not reaching an outer circumference of the pawl roller pair 40. A leading edge of the upstream end 44*b* joins the slanted guide face 41*b*, creating a gentle slope. Specifically, the upstream end 44*b* of the guide rib 44 extends to a position in proximity to the upstream edge 41*c* of the slanted guide face 41*b* and is disposed upstream from the slot 45 provided with the guide roller pair 43 in the recording medium conveyance direction D1.

Conversely, the downstream end 44*a* of the guide rib 44 extends to a position beside the guide roller pair 43. A trailing edge of the downstream end 44*a* joins the slanted guide face 41*b* at a position in proximity to the guide roller shaft 42. Specifically, the downstream end 44*a* of the guide rib 44 is beside and substantially parallel to the guide roller pair 43. That is, the downstream end 44*a* of the guide rib 44 is located inboard from an outer circumference of the guide roller pair 43 toward the guide roller shaft 42. A contact face 44*c* interposed between the upstream end 44*b* and the downstream end 44*a* in the recording medium conveyance direction D1 has a height from the slanted guide face 41*b* gradually increasing from the upstream end 44*b* to the downstream end 44*a*. As shown in FIG. 6, the contact face 44*c* draws a straight or substantially straight ridge line. The contact face 44*c* may have a planar surface with a predetermined width in a direction orthogonal to the recording medium conveyance direction D1 or an arcuate surface.

Referring to FIGS. 8A to 8D, the following describes an operation of the pawl 23*a* of the separator 23, the pawl roller pair 40, the guide rib 44, and the guide roller pair 43.

A detailed description is now given of an operation of the pawl 23*a* of the separator 23.

Figure 8A:
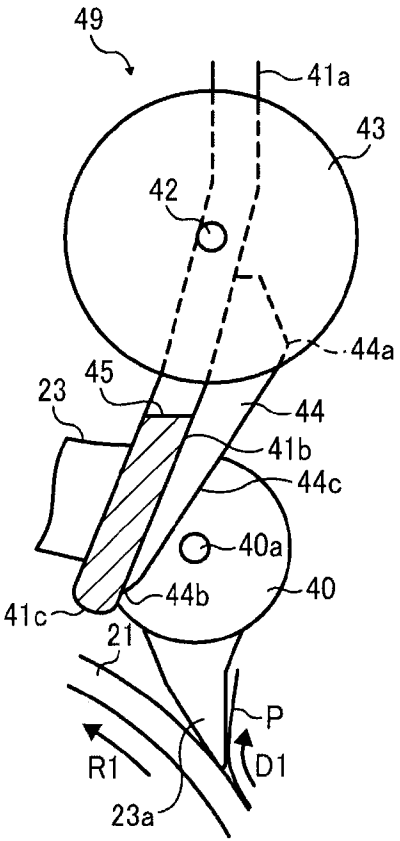
FIG. 8A is a vertical sectional view of the guide device shown in FIG. 6 illustrating a recording medium sliding over a pawl incorporated therein.
Figure 8B:
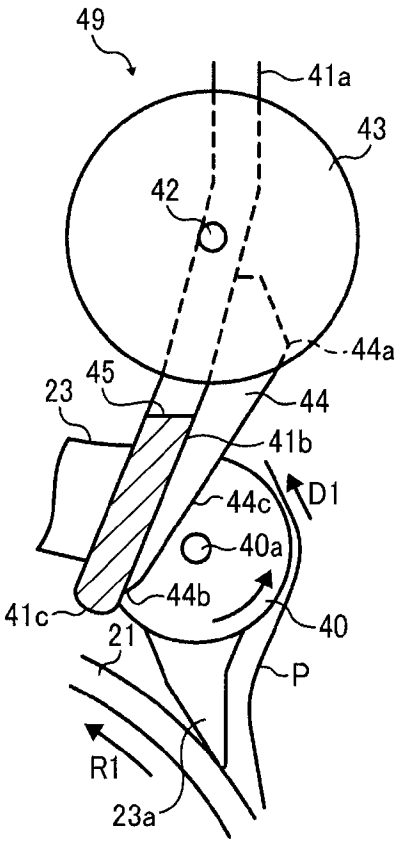
FIG. 8B is a vertical sectional view of the guide device shown in FIG. 6 illustrating the recording medium sliding over a pawl roller pair incorporated therein.

As shown in FIG. 8A, as the pawl 23*a* contacts the fixing roller 21, even if the recording medium P discharged from the fixing nip N still adheres to the fixing roller 21, the pawl 23*a* separates the recording medium P from the fixing roller 21. For example, when a leading edge of the recording medium P mounts a lift face of the pawl 23*a*, the recording medium P slides over the lift face of the pawl 23*a* toward the outer circumference of the pawl roller pair 40. The leading edge of the recording medium P mounts the lift face of the pawl 23*a* at an angle substantially equivalent to an angle of a tangential line formed between the outer circumference of the pawl roller pair 40 and the recording medium P contacting thereto. Accordingly, the leading edge of the recording medium P does not strike the pawl roller pair 40 but mounts the pawl roller pair 40 smoothly and moves upward as shown in FIG. 8B, decreasing pressure between the recording medium P and the pawl 23*a*. Consequently, even if the recording medium P stores heat conducted from the fixing roller 21 as the recording medium P passes through the fixing nip N, the pawl 23*a* does not scratch the soft toner image on the recording medium P softened by heat from the fixing roller 21, preventing scratches and glossy streaks produced on the toner image on the recording medium P.

Further, since the upstream end 44*b* of the guide rib 44 extends to a position inboard from the outer circumference of the pawl roller pair 40, the guide rib 44 interposed between the adjacent pawl roller pairs 40 lifts the recording medium P from the slanted guide face 41*b* in such a manner that the recording medium P is levitated from the slanted guide face 41*b*, thus guiding the recording medium P toward the guide roller pairs 43. Accordingly, the recording medium P is not bent in the width direction thereof orthogonal to the recording medium conveyance direction D1, reducing load imposed to the recording medium P.

Figure 8C:
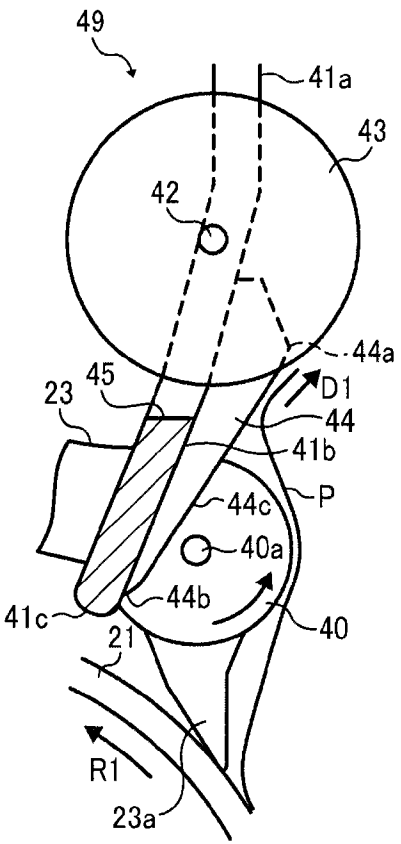
FIG. 8C is a vertical sectional view of the guide device shown in FIG. 6 illustrating the recording medium sliding over a guide rib incorporated therein.

Thereafter, as the leading edge of the recording medium P moves toward the lower outer circumferential surface of the guide roller pair 43, the leading edge of the recording medium P comes into contact with the contact face 44*c* of the guide rib 44 interposed between the pawl roller pair 40 and the guide roller pair 43 in the recording medium conveyance direction D1 and therefore does not contact the lower outer circumferential surface of the guide roller pair 43. For example, as shown in FIG. 8C, the leading edge of the recording medium P comes into contact with the contact face 44*c* of the guide rib 44 at a position upstream from the slot 45 in the recording medium conveyance direction D1 and slides over the contact face 44*c* toward the downstream end 44*a* of the guide rib 44 or substantially along a tangential line on the guide roller pair 43. Since the height from the slanted guide face 41*b* of the fixing exit guide 41 to the contact face 44*c* of the guide rib 44 gradually increases from the upstream end 44*b* to the downstream end 44*a* of the guide rib 44, the leading edge of the recording medium P is guided toward the guide roller pair 43 stably.

With a conventional configuration in which four pawl roller pairs are aligned in the axial direction of the fixing roller 21 with a greater interval provided between the adjacent pawl roller pairs, the leading edge of the recording medium P may enter the slot 45 in a region interposed between the adjacent pawl roller pairs. To address this problem, according to this exemplary embodiment, the guide ribs 44-1, 44-2, 44-3, 44-4, 44-5, and 44-6 are located in the region interposed between the adjacent pawl roller pairs 40-1, 40-2, 40-3, and 40-4 as shown in FIG. 5. Further, as shown in FIG. 6, the upstream end 44*b* of the guide rib 44 is disposed upstream from the slot 45 in the recording medium conveyance direction D1, preventing entry of the recording medium P into the slot 45.

Figure 8D:
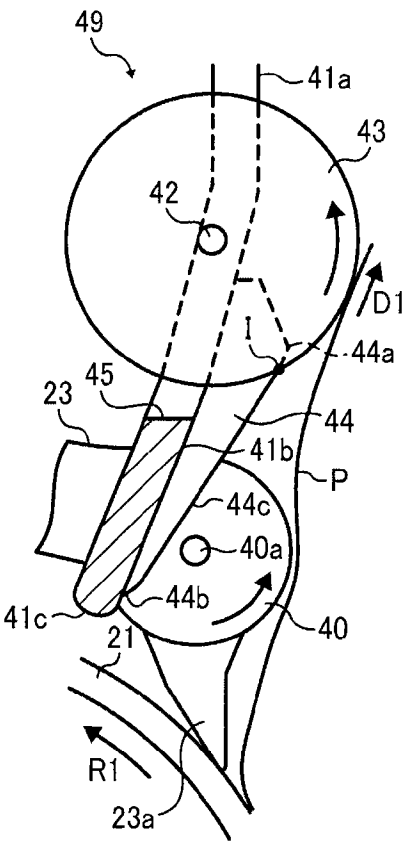
FIG. 8D is a vertical sectional view of the guide device shown in FIG. 6 illustrating the recording medium sliding over a guide roller pair incorporated therein.

As shown in FIG. 8D, since the downstream end 44*a* of the guide rib 44 extends to a position inboard from the outer circumference of the guide roller pair 43, as the leading edge of the recording medium P moves toward the outer circumferential surface of the guide roller pair 43, the recording medium P sliding over the contact face 44*c* of the guide rib 44 separates from the contact face 44*c* when the leading edge of the recording medium P passes through an intersection I where the contact face 44*c* of the guide rib 44 overlaps a lower outer circumference of the guide roller pair 43. Then, the leading edge of the recording medium P comes into contact with the outer circumferential surface of the guide roller pair 43. That is, the leading edge of the recording medium P moves from the contact face 44*c* of the guide rib 44 to the outer circumferential surface of the guide roller pair 43. Thereafter, as shown in FIG. 8D, the recording medium P moves from the pawl roller pair 40 to the guide roller pair 43 without contacting the contact face 44*c* of the guide rib 44. In other words, the leading edge of the recording medium P is guided by the fixing roller 21, the pawl 23*a* of the separator 23, the pawl roller pair 40, the contact face 44*c* of the guide rib 44, and the guide roller pair 43 in this order smoothly. After the leading edge of the recording medium P passes through the intersection I, the recording medium P is guided by the fixing roller 21, the pawl roller pair 40, and the guide roller pair 43 in this order smoothly. Hence, even if the recording medium P stores heat conducted from the fixing roller 21, the pawl 23*a* of the separator 23 does not produce scratches and glossy streaks on the soft toner image on the recording medium P that is softened by heat conducted from the fixing roller 21.

As shown in FIG. 7B, the guide ribs 44-1 and 44-2 are slanted in such a manner that an interval between the downstream end 44*a* of the guide rib 44-1 and the downstream end 44*a* of the guide rib 44-2 in the horizontal direction is smaller than an interval between the upstream end 44*b* of the guide rib 44-1 and the upstream end 44*b* of the guide rib 44-2 in the horizontal direction. Similarly, the guide ribs 44-5 and 44-6 are slanted in such a manner that an interval between the downstream end 44*a* of the guide rib 44-5 and the downstream end 44*a* of the guide rib 44-6 in the horizontal direction is smaller than an interval between the upstream end 44*b* of the guide rib 44-5 and the upstream end 44*b* of the guide rib 44-6 in the horizontal direction. Accordingly, the recording medium P contacts the guide ribs 44-1, 44-2, 44-5, and 44-6 for a shortened time and a shortened horizontal distance is provided between the downstream end 44*a* of the respective guide ribs 44-1, 44-2, 44-5, and 44-6 and the respective guide roller pairs 43-1 and 43-3, facilitating movement of the recording medium P from the guide ribs 44-1, 44-2, 44-5, and 44-6 sandwiching the guide roller pairs 43-1 and 43-3 to the guide roller pairs 43-1 and 43-3. Further, the slanted guide ribs 44-1, 44-2, 44-5, and 44-6 prevent entry of the recording medium P into the slots 45-1 and 45-3 precisely.

Referring to FIGS. 9A to 9D, the following describes movement of the recording medium P with a configuration of a comparative guide device 49C without the guide ribs 44-1, 44-2, 44-3, 44-4, 44-5, and 44-6.

Figure 9A:
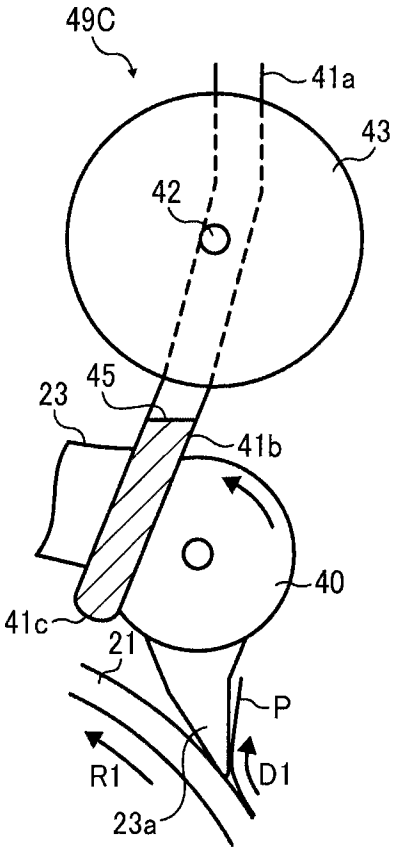
FIG. 9A is a vertical sectional view of a comparative guide device illustrating a recording medium sliding over a pawl incorporated therein.
Figure 9B:
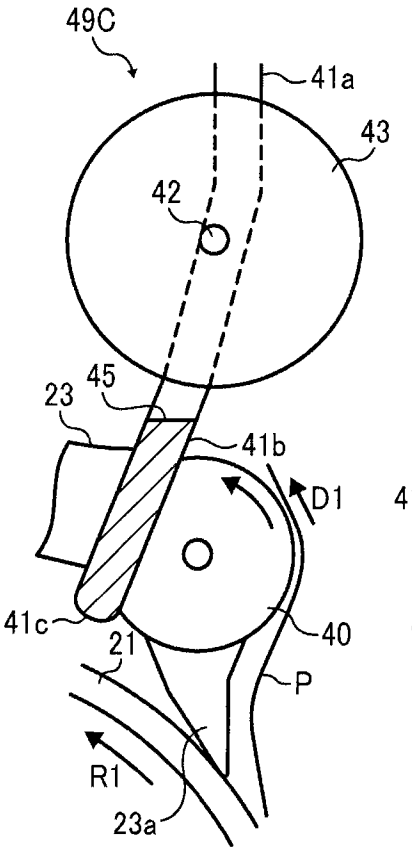
FIG. 9B is a vertical sectional view of the comparative guide device shown in FIG. 9A illustrating the recording medium sliding over a pawl roller pair incorporated therein.
Figure 9C:
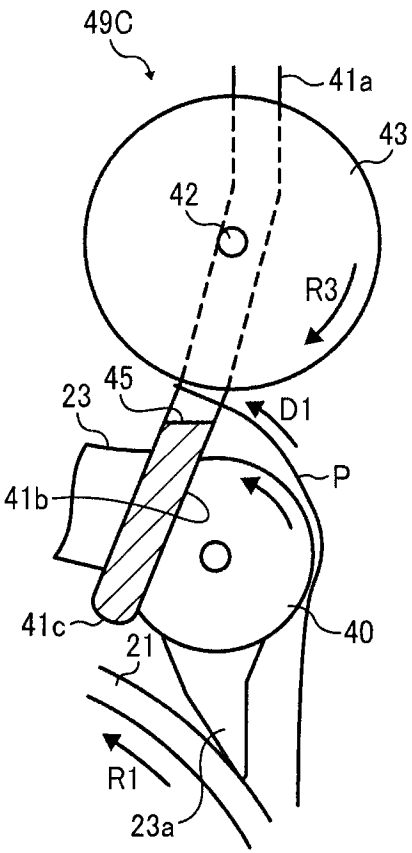
FIG. 9C is a vertical sectional view of the comparative guide device shown in FIG. 9A illustrating the recording medium entering a slot incorporated therein.
Figure 9D:
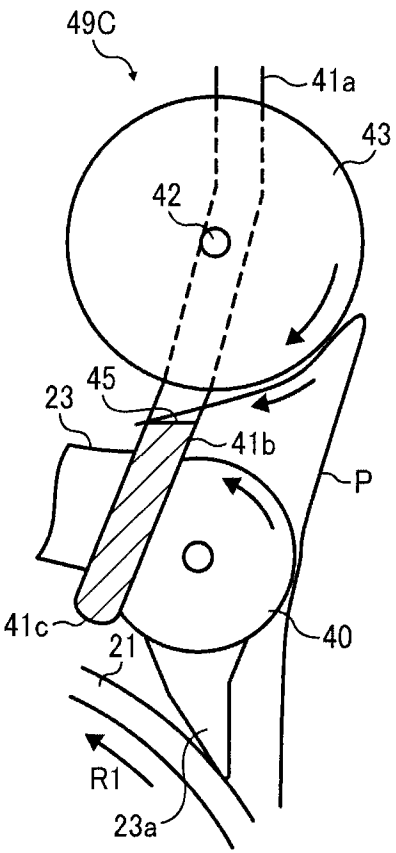
FIG. 9D is a vertical sectional view of the comparative guide device shown in FIG. 9A illustrating the recording medium bent by a guide roller pair incorporated therein.

As shown in FIGS. 9A and 9B, the leading edge of the recording medium P is guided by the fixing roller 21, the pawl 23*a* of the separator 23, and the pawl roller pair 40 in this order as in the guide device 49 depicted in FIGS. 8A and 8B. However, as shown in FIG. 9C, when the leading edge of the recording medium P comes close to the slanted guide face 41*b*, the leading edge of the recording medium P may move beneath the guide roller pair 43 due to curling of the recording medium P and the curvature of the lift face of the pawl 23*a*. Accordingly, the leading edge of the recording medium P comes into contact with the guide roller pair 43 and rotates the guide roller pair 43 clockwise in FIG. 9C in a rotation direction R3 as the leading edge of the recording medium P enters the slot 45. Thereafter, as shown in FIG. 9D, the recording medium P is bent at an acute angle, generating jamming of the recording medium P and damage to the recording medium P such as bending of the leading edge or corner of the recording medium P. Hence, without the guide rib 44, the leading edge of the recording medium P may not be guided from the pawl roller pair 40 to the guide roller pair 43 smoothly. Accordingly, the leading edge of the recording medium P may enter the slot 45, generating jamming of the recording medium P and damage to the recording medium P. Especially, a soft recording medium P is susceptible to such failures.

Conversely, with the guide device 49 shown in FIGS. 8A to 8D according to this exemplary embodiment, the recording medium P is guided by the pawl 23*a* of the separator 23, the pawl roller pair 40, the guide rib 44, and the guide roller pair 43 in this order. When the trailing edge of the recording medium P is discharged from the fixing nip N and passes over the pawl 23*a* of the separator 23, the pawl 23*a* separates from the fixing roller 21 as shown in FIG. 2. For example, after the tailing edge of the recording medium P passes through the fixing nip N, the controller 37 interrupts an electric current supply to the solenoid 30 and therefore the plunger 32 no longer retracts into the body 31. Accordingly, the separator presser 27 presses down the base 23*b* of the separator 23 by a resilient bias exerted by the separation direction biasing member 29 that generates the rotation moment M3. Consequently, the separator 23 rotates counterclockwise in FIG. 2 by the rotation moment M2.

As described above, the rotation moment M2 exerted by the separation direction biasing member 29 to the separator 23 to rotate the separator 23 counterclockwise in FIG. 2 is greater than the rotation moment M1 exerted by the contact direction biasing member 26 to the separator 23 to rotate the separator 23 clockwise in FIG. 2. Accordingly, the separator 23 rotates counterclockwise in FIG. 2 and therefore the pawl 23*a* separates from the fixing roller 21. Whenever the recording medium P is conveyed through the fixing nip N, the separator 23 is brought into contact with and separated from the fixing roller 21.

Referring to FIGS. 3, 5, and 6, the following describes advantages of the guide device 49 described above. As shown in FIG. 3, the guide device 49 guides a recording medium P bearing a toner image T discharged from the fixing nip N formed between the fixing roller 21 serving as a fixing rotary body and the pressing roller 22 serving as a pressing rotary body. As shown in FIG. 6, the guide device 49 is disposed downstream from the fixing roller 21 in the recording medium conveyance direction D1 and includes the separator 23 separatably contacting the outer circumferential surface of the fixing roller 21 to separate the recording medium P from the fixing roller 21; the pawl roller pair 40 serving as a first rotary body disposed adjacent to the separator 23 to contact and support an image side of the recording medium P bearing the toner image T and isolated from the fixing roller 21; the fixing exit guide 41 having the slanted guide face 41*b* that faces the image side of the recording medium P supported by the pawl roller pair 40; the guide roller pair 43 serving as a second rotary body disposed downstream from the pawl roller pair 40 and partially protruding from the slanted guide face 41*b* of the fixing exit guide 41 to contact and support the image side of the recording medium P; and the guide rib 44 mounted on the slanted guide face 41*b* of the fixing exit guide 41 and extending substantially in the recording medium conveyance direction D1. The guide rib 44 has the contact face 44*c* that contacts the image side of the recording medium P and the downstream end 44*a* disposed downstream from the contact face 44*c* in the recording medium conveyance direction D1 and overlapping the guide roller pair 43 in cross-section taken along a direction orthogonal to an axial direction of the guide roller pair 43. That is, the downstream end 44*a* of the guide rib 44 is inboard from the lower outer circumference of the guide roller pair 43 toward the guide roller shaft 42 of the guide roller pair 43.

The contact face 44*c* of the guide rib 44 contacts and guides the leading edge of the recording medium P passing over the separator 23 and the pawl roller pair 40 to the outer circumferential surface of the guide roller pair 43. Accordingly, the leading edge of the recording medium P does not strike the outer circumferential surface of the guide roller pair 43 at a position in proximity to the slanted guide face 41*b* of the fixing exit guide 41 at an acute angle. Further, the components, that is, the separator 23, the pawl roller pair 40, the guide rib 44, and the guide roller pair 43, support the recording medium P while they share a load imposed to the recording medium P, thus reducing pressure between each of them and the recording medium P. Hence, the plurality of components that contacts the recording medium P does not produce scratches and glossy streaks on the toner image T on the recording medium P, preventing formation of a faulty toner image.

Additionally, the guide rib 44 prevents the leading edge of the recording medium P from entering the slot 45 inside which the guide roller pair 43 is situated, thus preventing damage to the recording medium P such as bending of the leading edge and corner of the recording medium P.

The present invention is not limited to the details of the exemplary embodiments described above, and various modifications and improvements are possible. For example, according to the exemplary embodiments described above, the fixing roller 21 serves as a fixing rotary body. Alternatively, the fixing rotary body may be an endless belt, an endless film, or the like. Further, according to the exemplary embodiments described above, the pressing roller 22 serves as a pressing rotary body. Alternatively, the pressing rotary body may be an endless belt, a pad, a plate, or the like.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A guide device disposed downstream from a fixing rotary body in a recording medium conveyance direction that heats a toner image on a recording medium and guiding the recording medium conveyed from the fixing rotary body, the guide device comprising:

a separator separatably contacting an outer circumferential surface of the fixing rotary body to separate the recording medium from the fixing rotary body;

a first rotary body disposed adjacent to the separator to contact and support an image side of the recording medium bearing the toner image;

a fixing exit guide having a guide face facing the image side of the recording medium supported by the first rotary body and provided with a slot;

a second rotary body disposed downstream from the first rotary body in the recording medium conveyance direction and partially protruding from the guide face through the slot of the fixing exit guide to contact and support the image side of the recording medium; and at least one guide rib mounted on the guide face of the fixing exit guide and extending substantially in the recording medium conveyance direction, the at least one guide rib including:

a contact face contacting the image side of the recording medium; and a downstream end disposed downstream from the contact face in the recording medium conveyance direction to overlap the second rotary body in cross-section taken along a direction orthogonal to an axial direction of the second rotary body.

2. The guide device according to claim 1, wherein the at least one guide rib further includes an upstream end disposed upstream from the contact face in the recording medium conveyance direction to overlap the first rotary body in cross-section taken along a direction orthogonal to an axial direction of the first rotary body.

3. The guide device according to claim 2, wherein the upstream end of the at least one guide rib is disposed upstream from the slot created through the guide face of the fixing exit guide.

4. The guide device according to claim 1, wherein a height of the at least one guide rib defined by a dimension from the guide face of the fixing exit guide to the contact face of the at least one guide rib gradually increases from the upstream end to the downstream end of the at least one guide rib.

5. The guide device according to claim 1, wherein at least one the guide rib is slanted with respect to the recording medium conveyance direction.

6. The guide device according to claim 1, wherein the at least one guide rib is parallel to the recording medium conveyance direction.

7. The guide device according to claim 1, wherein the at least one guide rib includes two guide ribs that sandwich the second rotary body in the axial direction of the second rotary body.

8. The guide device according to claim 1, wherein the at least one guide rib includes a plurality of guide ribs being symmetric with respect to a center line of the guide face of the fixing exit guide in the axial direction of the second rotary body.

9. The guide device according to claim 1, wherein the fixing rotary body includes a fixing roller and each of the first rotary body and the second rotary body includes a roller pair.

10. The guide device according to claim 1, wherein the separator includes a pawl separatably contacting the outer circumferential surface of the fixing rotary body.

11. The guide device according to claim 1, wherein the fixing exit guide includes a plate.

12. The guide device according to claim 1, further comprising:

a first shaft rotatably mounting the first rotary body; and a second shaft rotatably mounting the second rotary body, wherein the first shaft and the second shaft are aligned on a substantially vertical line and extended in parallel to each other, and wherein a diameter of the second rotary body is greater than a diameter of the first rotary body.

13. The guide device according to claim 12, wherein the guide face of the fixing exit guide includes:

an upstream edge disposed upstream from the slot in the recording medium conveyance direction and aligned with the first rotary body in an axial direction of the first rotary body; and a downstream edge disposed downstream from the upstream edge in the recording medium conveyance direction and aligned with the second rotary body in the axial direction of the second rotary body.

14. A fixing device comprising the guide device according to claim 1.

15. An image forming apparatus comprising the fixing device according to claim 14.

* * * * *